US005344351A

United States Patent [19]

Danielson

[11] Patent Number: 5,344,351

[45] Date of Patent: Sep. 6, 1994

[54] OPAQUE LIFE JACKET CAPE

[76] Inventor: Samuel M. Danielson, 655 S. 12th St., San Jose, Calif. 95112

[21] Appl. No.: 130,706

[22] Filed: Oct. 4, 1993

[51] Int. Cl.[5] ..... B63H 21/32

[52] U.S. Cl. ..... 441/89; 441/80

[58] Field of Search ..... 441/88–119, 441/136; 2/88

[56] References Cited

U.S. PATENT DOCUMENTS

| | | | |
|---|---|---|---|
| 309,032 | 12/1894 | Ledóchowski | 441/89 |
| 4,725,252 | 2/1988 | McNeil | 441/89 |
| 5,245,943 | 9/1993 | Hull et al. | 441/89 |

FOREIGN PATENT DOCUMENTS

| | | | |
|---|---|---|---|
| 0024695 | 2/1986 | Japan | 441/89 |

*Primary Examiner*—Edwin L. Swinehart
*Attorney, Agent, or Firm*—E. Michael Combs

[57] ABSTRACT

A cape structure in combination with a life jacket is arranged for enhanced visibility of an individual wearing the life jacket, with the cape including buoyancy components and formed of opaque readily visible material. The cape is normally arranged in a furled configuration relative to the life jacket structure at the collar portion of the life jacket.

4 Claims, 4 Drawing Sheets

OPAQUE LIFE JACKET CAPE

BACKGROUND OF THE INVENTION

1. Field of the Invention

The field of invention relates to life jacket structure, and more particularly pertains to a new and improved opaque life jacket cape wherein the same is arranged in a mounted configuration relative to a life jacket and configured for buoyancy.

2. Description of the Prior Art

Life jacket structure of various types are indicated in the prior art and are exemplified by the U.S. Pat. Nos. 4,863,409 and 4,194,257.

The instant invention attempts to overcome deficiencies of the prior art by providing a cape structure for enhanced visibility in the viewing of an individual directed into the water and in this respect, the present invention substantially fulfills this need.

SUMMARY OF THE INVENTION

In view of the foregoing disadvantages inherent in the known types of life jacket structure now present in the prior art, the present invention provides an opaque life jacket cape formed of a flexible opaque material readily visible and arranged for flotation relative to an associated life jacket. As such, the general purpose of the present invention, which will be described subsequently in greater detail, is to provide a new and improved opaque life jacket cape which has all the advantages of the prior art life jacket apparatus and none of the disadvantages.

To attain this, the present invention provides a cape structure in combination with a life jacket for enhanced visibility of an individual wearing the life jacket, with the cape including buoyancy components and formed of opaque readily visible material. The cape is normally arranged in a furled configuration relative to the life jacket structure at the collar portion of the life jacket.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved opaque life jacket cape which has all the advantages of the prior art life jacket apparatus and none of the disadvantages.

It is another object of the present invention to provide a new and improved opaque life jacket cape which may be easily and efficiently manufactured and marketed.

It is a further object of the present invention to provide a new and improved opaque life jacket cape which is of a durable and reliable construction.

An even further object of the present invention is to provide a new and improved opaque life jacket cape which is susceptible of a low cost of manufacture with regard to both materials and labor, and which accordingly is then susceptible of low prices of sale to the consuming public, thereby making such opaque life jacket capes economically available to the buying public.

Still yet another object of the present invention is to provide a new and improved opaque life jacket cape which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
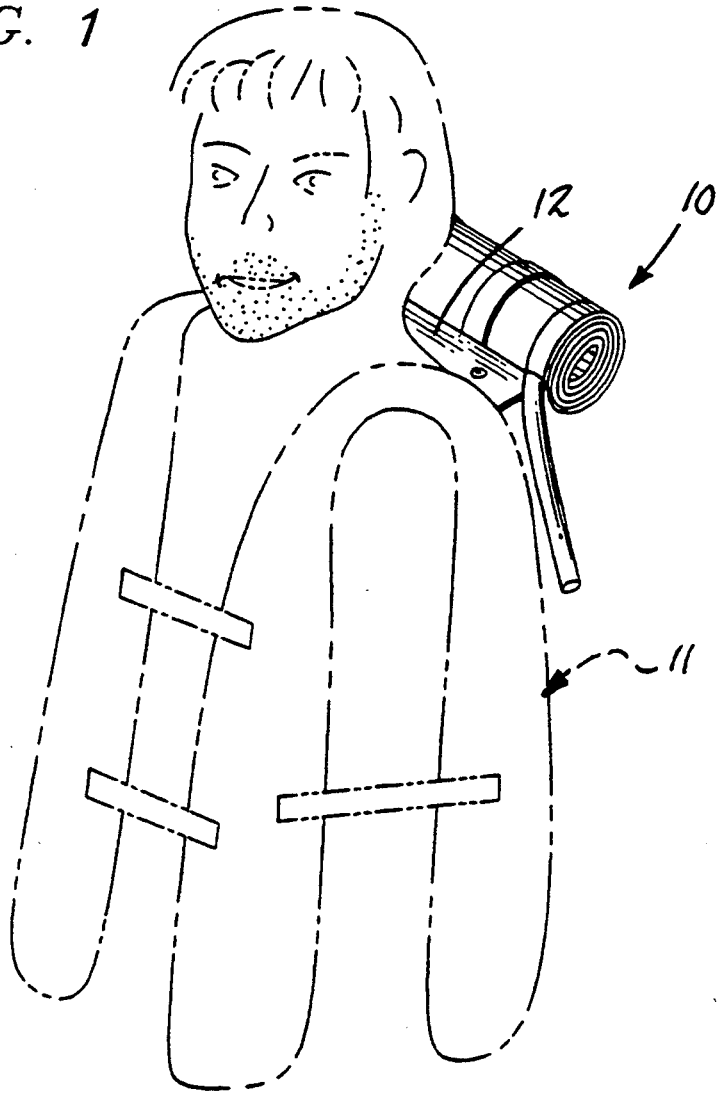
FIG. 1 is an isometric illustration of the invention.

With reference now to the drawings, and in particular to FIGS. 1 to 8 thereof, a new and improved opaque life jacket cape embodying the principles and concepts of the present invention and generally designated by the reference numeral 10 will be described.

Figure 2:
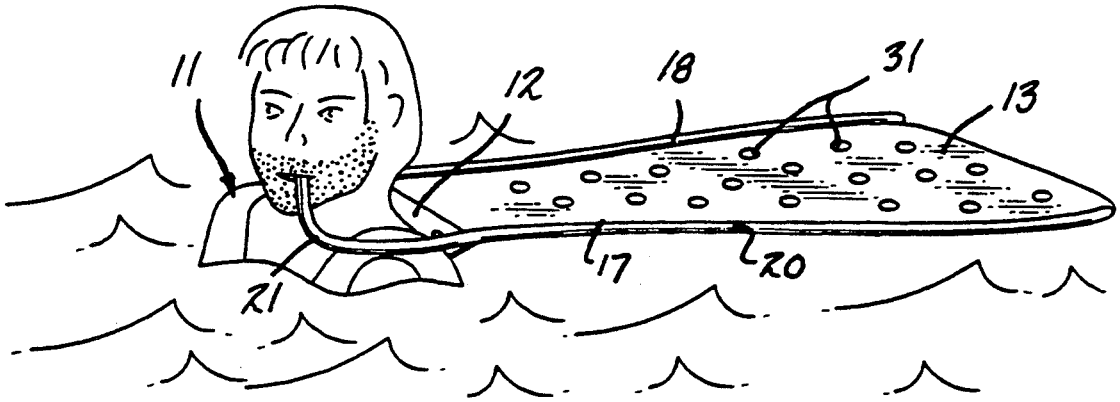
FIG. 2 is an isometric illustration of the invention in use.
Figure 5:
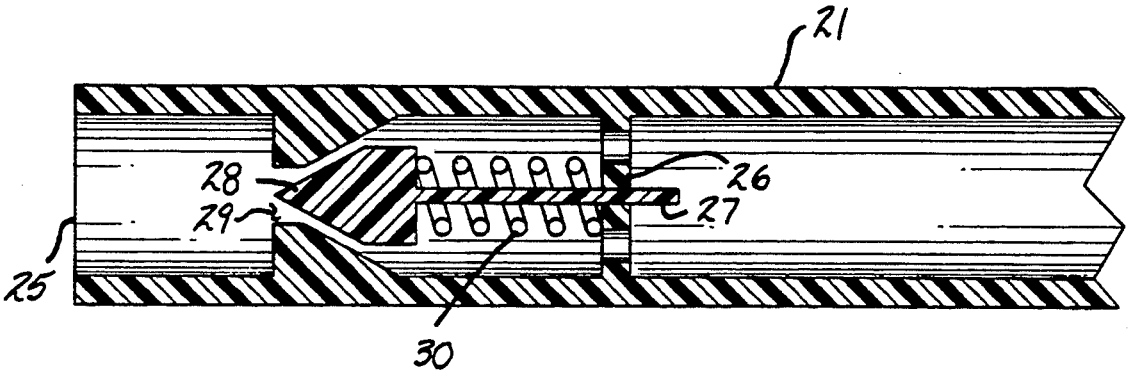
FIG. 5 is an orthographic view, taken along the lines 5—5 of FIG. 4 in the direction indicated by the arrows, to indicate a valve member arranged relative to each inflation tube.
Figure 6:
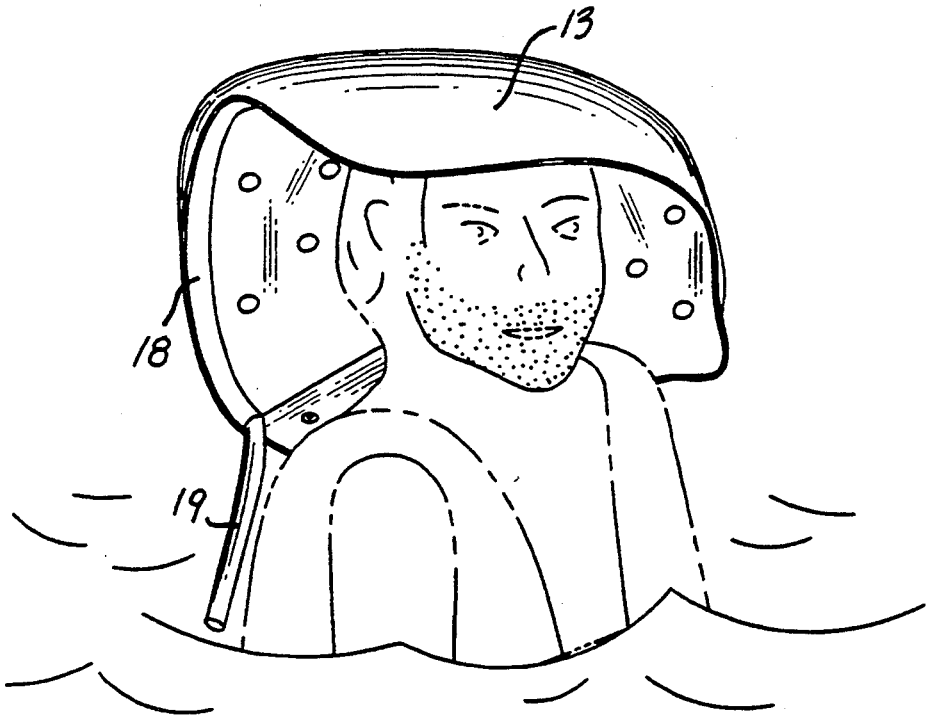
FIG. 6 is an isometric illustration of the invention arranged for use as a cover hood.
Figure 7:
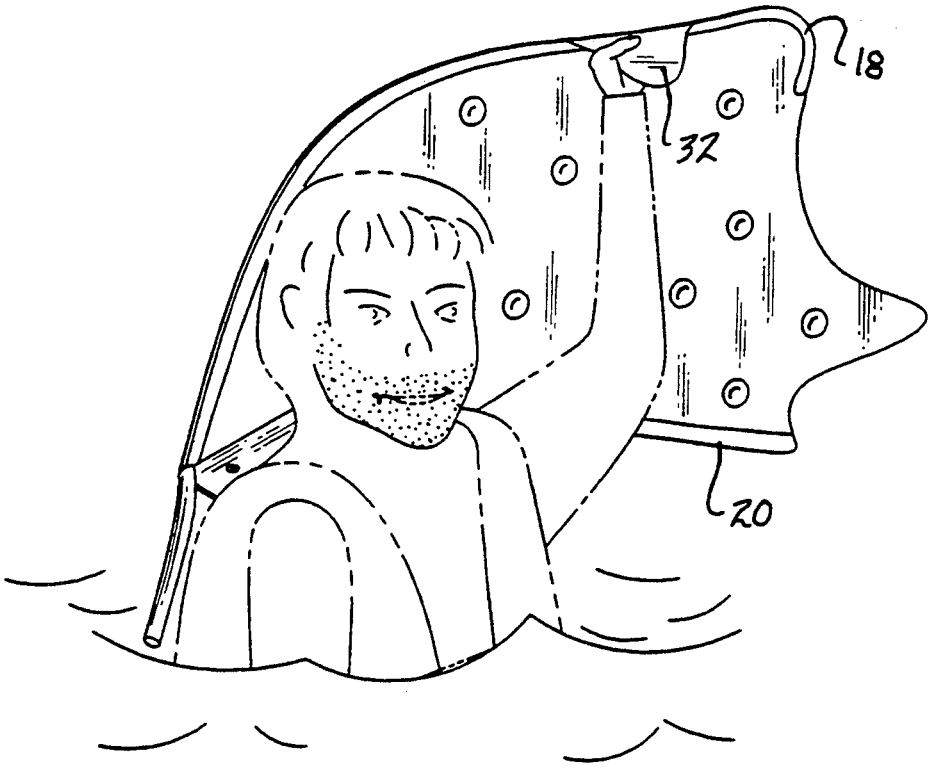
FIG. 7 is an isometric illustration of the invention arranged for use as a flagging member.

More specifically, the opaque life jacket cape 10 of the instant invention essentially comprises mounting to a buoyant life jacket 11 of conventional construction, or of a type as indicated in U.S. Pat. No. 4,863,409 incorporated herein by reference, wherein the cape structure includes a cape flange 12 arranged relative and in fixed securement to the collar portion of the life jacket 11. The cape flange 12 has mounted thereto a flexible web 13 at a flexible web first end 14, with a web second end 15 spaced therefrom. The flexible web is of a generally trapezoidal configuration, having first and second sides 16 and 17 canted towards one another from the second end 15 towards the first end 14. A first pneumatic tube 18 is coextensive with the first side 16, with a second pneumatic tube 20 coextensive with the second side 17. The first pneumatic tube 18 includes a first inflation tube 19, while the second pneumatic tube 20 includes a second inflation tube 21. The first and second inflation tubes extend and project from the respective first and second pneumatic tubes for ease of access by an individual, as indicated in FIG. 2. Further, each of the inflation tubes includes a one-way valve structure of a type as indicated in FIG. 5. Each inflation tube to this end includes a tube entrance end 25 to receive oral inflation therethrough, with a support web 26 spaced from the entrance end 25. The support web 26 includes a shaft 27 orthogonally and reciprocatably directed therethrough, with the shaft 27 having a plug 28 fixedly secured at a forward distal end of the shaft for reception with an orifice opening 29, such that a spring 30 captured between the plug 28 and support web 26 biases the plug 28 into pneumatic sealing with the orifice opening 29. Upon inflation by directing pneumatic pressure into the entrance opening 25, the plug 28 is displaced permitting pressurizing of a respective pneumatic tube of the first and second pneumatic tubes 18 and 20.

The flexible web 13 includes a matrix of encapsulated pneumatically sealed buoyancy chambers 31 coextensive with the web to enhance flotation of the web, and as the web is formed of an opaque readily visible material, the same functions for ease of visibility of an individual within a water environment, such as indicated in FIG. 2. The FIG. 6 indicates the web utilized as a cover flap, with the FIG. 7 indicating the web further employing a hand flap 32 to permit manual grasping of the web for its use as a signal flag.

Figure 3:
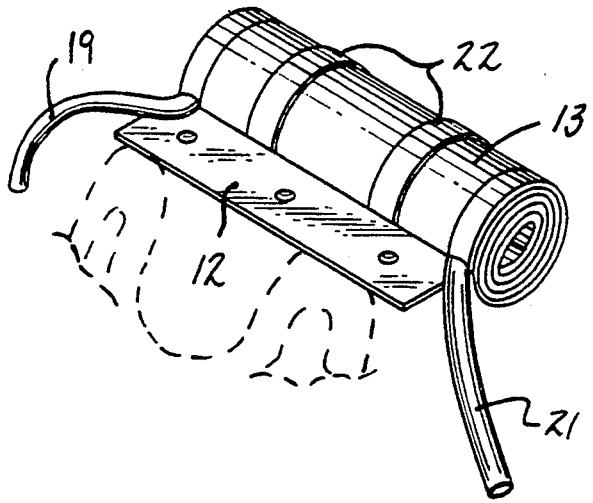
FIG. 3 is an isometric illustration arranged in a furled configuration relative to an associated life jacket.
Figure 4:
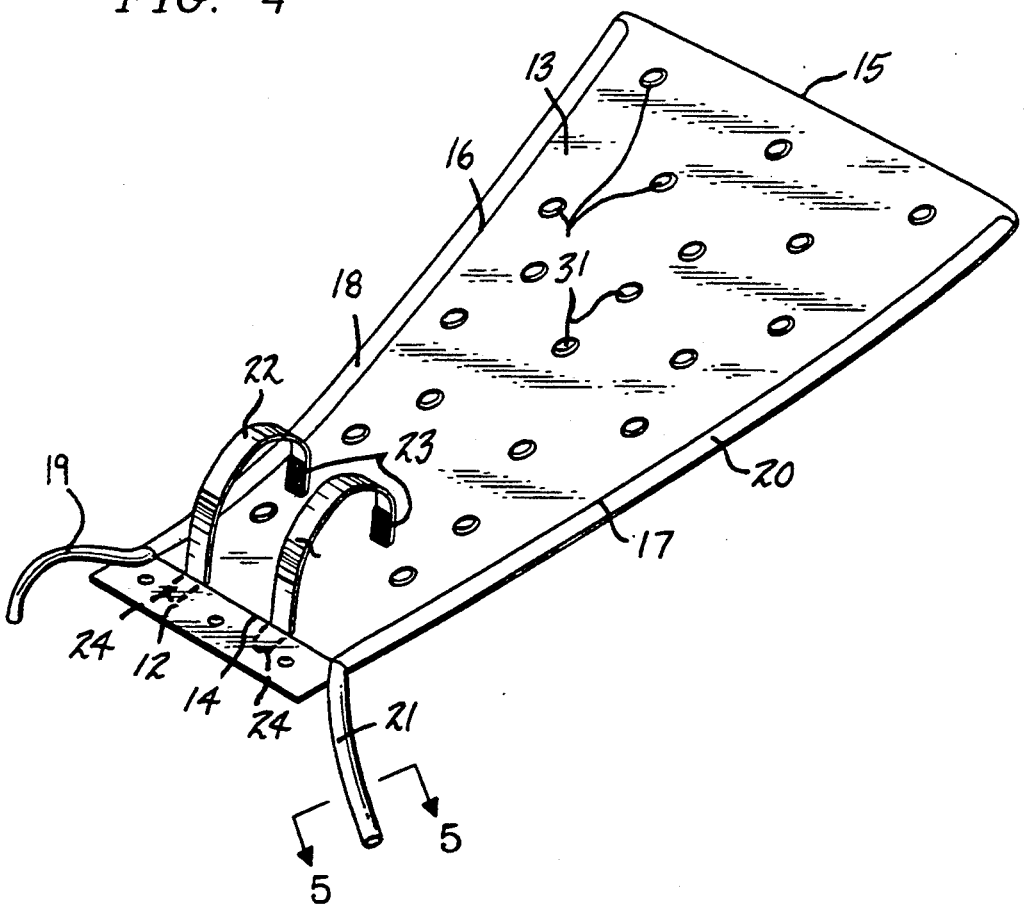
FIG. 4 is an enlarged isometric illustration of the invention in an extended orientation.
Figure 8:
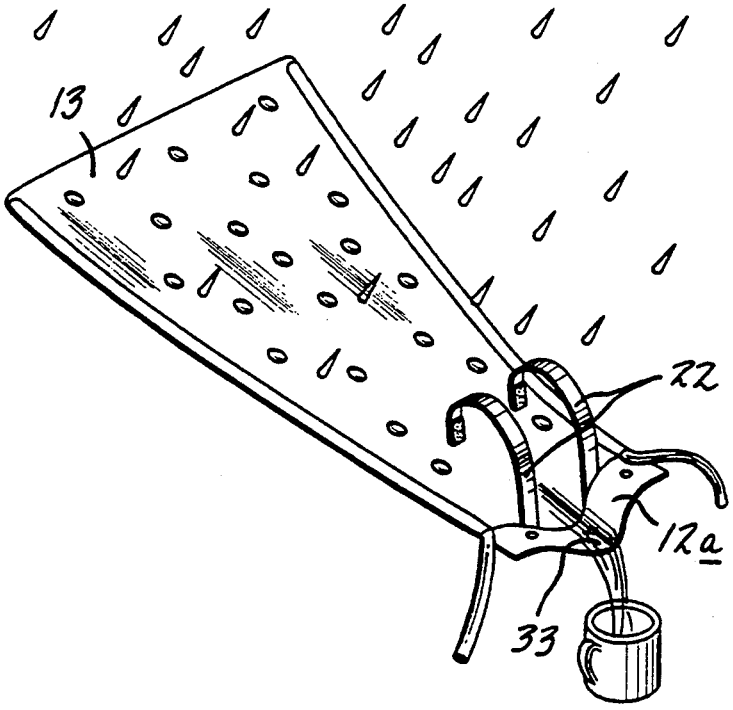
FIG. 8 is an isometric illustration of the invention to further include a trough to collect rain water.

The FIG. 8 includes a modified cape flange 12 having a trough 33 directed medially thereof, with the trough longitudinally aligned medially of the web 13 to permit the collection of rain water into a receptacle, as indicated in FIG. 8. The trough therefore is positioned in a separated manner relative to the life jacket 11 between life jacket shoulder portions, such as indicated in FIG. 3, to permit the rain water to be directed along a trough 33 for collection into the receptacle as illustrated.

It should be noted that securement straps 22 extend fixedly from the intersection of the web first end 14 to the cape flange 12, such that each of the securement straps 22 include a first hook and loop fastener 23 at a free distal end of each respective securement strap 22. A bottom surface of the cape flange 12 includes a plurality of second hook and loop fasteners, with each of said second hook and loop fasteners 24 arranged for securement to one of said first hook and loop fasteners 23 to secure the web 13 in a furled configuration, as illustrated in FIG. 1, when the first fasteners 23 are secured to the second fasteners 24, as illustrated in the FIG. 1 and the FIG. 3.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and desired to be protected by Letters Patent of the United States is as follows:

1. An opaque life jacket cape in combination with a buoyant life jacket, wherein the life jacket includes a collar portion and wherein the cape includes a cape flange fixedly mounted to the life jacket collar portion, and a flexible web having a web first end spaced from a web second end and a web first side spaced from a web second side, with the web first end integrally mounted coextensively with the cape flange, and the web includes a matrix of encapsulated pneumatically sealed buoyancy chambers throughout the flexible web to enhance buoyancy of the web, and the first side includes a first pneumatic tube coextensive therewith, and the second side includes a second pneumatic tube coextensive therewith, with a first inflation tube in pneumatic communication with the first pneumatic tube, the first inflation tube extending beyond the cape flange, and a second inflation tube in pneumatic communication with the second pneumatic tube, with the second inflation tube extending beyond the cape flange, with the first pneumatic tube and the second pneumatic tube each including a respective one-way valve therewithin.

2. A cape as set forth in claim 1 wherein each one-way valve includes a support web, and each support web having a shaft reciprocatably mounted orthogonally therethrough, each shaft having a plug spaced from the support web, and an orifice opening spaced from the support web, with a spring captured between the plug and the support web biasing the plug into the orifice opening.

3. A cape as set forth in claim 2 wherein the cape flange includes a trough depression medially of said cape flange, with the trough longitudinally aligned medially of the web.

4. A cape as set forth in claim 3 including at least one securement strap extending from the cape flange at an intersection of the cape flange with the web first end, and the securement strap including a first hook and loop fastener at a free distal end of the securement strap from the intersection, and the cape flange having a flange top wall and a flange bottom wall, with the securement strap projecting above the flange top wall, with a second hook and loop fastener mounted to the flange bottom wall for securement to the first hook and loop fastener when the flexible web is in a furled configuration in adjacency to the cape flange.

* * * * *